US007278893B1

(12) United States Patent
Frantz

(10) Patent No.: US 7,278,893 B1
(45) Date of Patent: Oct. 9, 2007

(54) COMBINED MOTORBOAT TRANSOM SAVER AND ANTI-THEFT PROPELLER LOCK DEVICE

(76) Inventor: Donald R. Frantz, 1785 S. Johnson Rd., New Berlin, WI (US) 53146

( * ) Notice: Subject to any disclaimer, the term of this patent is extended or adjusted under 35 U.S.C. 154(b) by 0 days.

(21) Appl. No.: 11/571,805

(22) PCT Filed: Jul. 9, 2004

(86) PCT No.: PCT/US2004/022211

§ 371 (c)(1),
(2), (4) Date: Mar. 16, 2007

(87) PCT Pub. No.: WO2006/016874

PCT Pub. Date: Feb. 16, 2006

(51) Int. Cl.
*B63H 1/14* (2006.01)

(52) U.S. Cl. ..... 440/49; 70/431

(58) Field of Classification Search ..... 440/49, 440/53; 70/431

See application file for complete search history.

(56) References Cited

U.S. PATENT DOCUMENTS 2,901,267 A * 8/1959 Holsclaw ..... 248/503
4,331,431 A * 5/1982 Estes ..... 440/53
4,438,899 A * 3/1984 Perkins et al. ..... 248/642
5,184,488 A * 2/1993 Sandlin ..... 70/14
5,509,592 A * 4/1996 Lipka ..... 224/521
2001/0044243 A1* 11/2001 Thompson et al. ..... 440/55

* cited by examiner

*Primary Examiner*—Stephen Avila
(74) *Attorney, Agent, or Firm*—Joseph S. Heino; Patrick M. Bergin

(57) ABSTRACT

A combined support and lock device (10) has a longitudinally extending support portion (20) and a longitudinally extending lock portion (50). The support portion (20) includes a centrally disposed strut (22) having a first end (24) and a second end (26). The first strut end (24) is adapted to rest against a member (8) of a boat trailer frame (6). The second strut end (26) is adapted to rest against a portion of a boat motor (12). The lock portion (50) includes a hook-like rod (60) having a first end (62) and a second end (66). The first end (62) of the rod (60) is curved (64) so as to engage a recess (18) defined within the rearward portion of the boat motor propeller (16). The rod (60) extends between two adjacent propeller blades (17) to prevent rotation of the propeller (16). The second end (66) of the rod (60) is lockable within a pivotable locking flange (52) the locking flange (52) being rotatably secured to the second strut end (26) of the support portion (20) of the device (10).

18 Claims, 4 Drawing Sheets

COMBINED MOTORBOAT TRANSOM SAVER AND ANTI-THEFT PROPELLER LOCK DEVICE

FIELD OF THE INVENTION

The present invention relates generally to locks and other security devices. More specifically, it relates to a device that is used to secure a motorboat propeller to the motorboat motor when the boat is not in use. It also relates to such a device that combines a transom saving element with the device to prevent torsional forces being exerted on the motorboat transom when the motor is in the elevated position for transport of the motorboat.

BACKGROUND OF THE INVENTION

Recreational boating typically requires that motorboats be transported from one body of water to another. For outboard motor applications, this usually means that the motor, which is mounted to the boat transom, must be elevated such that the lowermost portion of the boat motor does not strike the ground or other obstacles at ground level. As the boat moves during transport, the elevated boat motor places dynamic torsional forces on that part of the boat transom to which the boat motor is mounted. Accordingly, it is desirable to place an additional support under the boat motor during elevation and transport to reduce those torsional forces.

Another unfortunate reality concerning motorboats is that the propeller of the elevated boat motor is vulnerable to theft since it can be relatively quickly and easily removed from the boat motor. Propellers are typically a very expensive component of the boat motor assembly. Propellers must be made of metal materials that are strong enough to perform as intended, which metal materials can be expensive, thus making replacement of the propeller an expensive proposition as well.

SUMMARY OF THE INVENTION

What is needed is a device for securely and inexpensively supporting the boat motor during transport while at the same time locking the propeller to the motor. The present invention provides such a device that, when used properly, helps to prevent theft of boat motor propellers and provides support for the elevated boat motor and for the boat transom. The present invention provides for a unique locking device having a longitudinally extending support portion and a longitudinally extending lock portion. The support portion includes a centrally disposed strut having a first end and a second end. The first strut end is functionally adapted to rest against a member of the boat trailer frame. The second strut end is functionally adapted to rest against a portion of the boat motor. The lock portion includes a hook-like rod having a first end and a second end. The first end of the rod is curved so as to engage the recess that is defined within the rearward portion of the boat motor propeller. The rod extends between two adjacent propeller blades to prevent rotation of the propeller. The second end of the rod is lockable within a pivotable locking member, which locking member is also secured to the second strut end of the support portion of the device. The foregoing and other features of the device of the present invention will be apparent from the detailed description that follows.

DETAILED DESCRIPTION OF THE INVENTION

Figure 1:
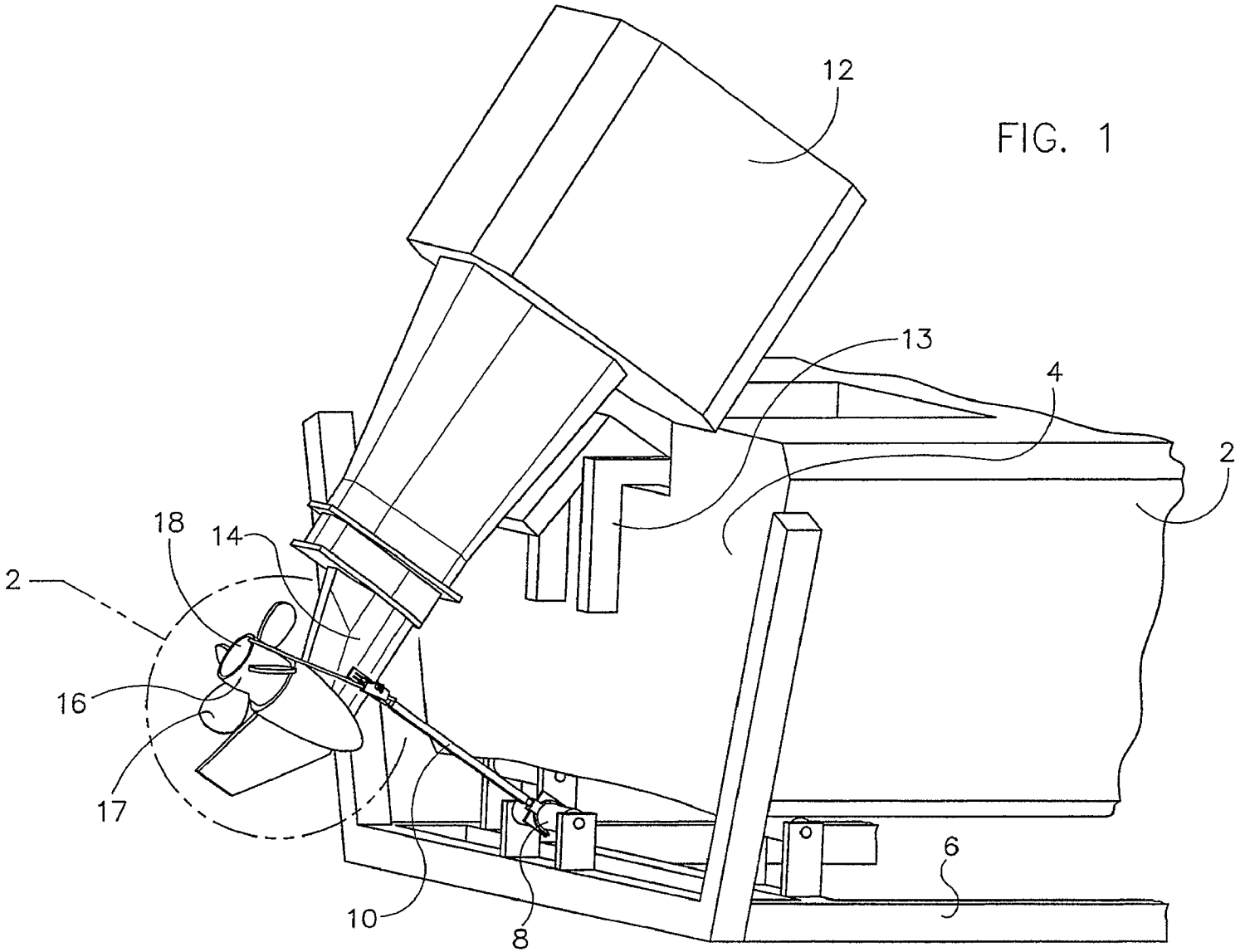
FIG. 1 is a perspective view of the combined supporting and locking device of the present invention as it is used with a boat motor that is mounted to a boat, which boat is situated atop a trailer for transport.
Figure 4:
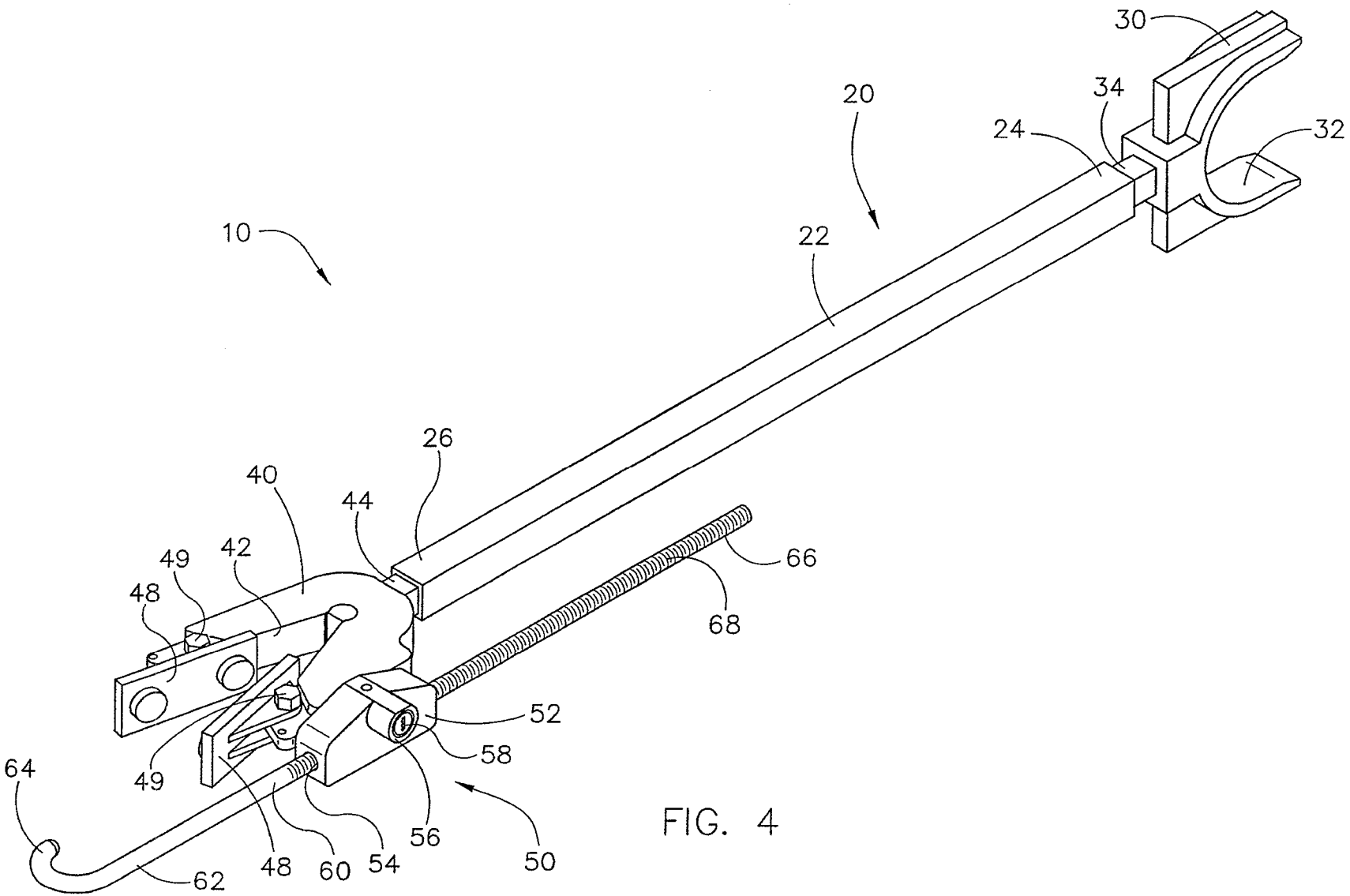
FIG. 4 is a further enlarged front, top and left side perspective view of the combined supporting and locking device of the present invention.

Referring now to the drawings in detail, wherein like numbered elements correspond to like elements throughout, FIG. 1 is a perspective view showing the combined supporting and locking device, generally identified 10, constructed in accordance with the present invention as it is used with a trailered boat 2 and boat motor 12. Broadly speaking, the combined supporting and locking device 10 of the present invention includes a support portion, generally identified 20, and a lock portion, generally identified 50. See FIG. 4.

The support portion 20 of the combined supporting and locking device 10 includes a longitudinally extending central strut 22. The strut 22 includes a first end 24 and a second end 26. In the preferred embodiment, the strut 22 is formed of a longitudinally extending piece of sturdy tubular square material having a square central hollow defined therewithin. It is to be understood, however, that the cross-sectional square profile of the strut 22 could assume any form and still come within the scope of the invention. That is, the strut 22 could assume a circular, oblate, or even rectangular cross-section without deviating from the scope of this invention. Preferably, the strut 22 is formed from a single piece of metal material, although other sturdy materials could be used. Additionally, the strut 22 could be comprised of a solid structure as opposed to a hollow one.

The support portion 20 of the device 10 also includes a generally "U-shaped" frame collar 30. The U-shaped frame collar 30 is situated at the first end 24 of the strut 22 and is variably and slidably attachable to it. The frame collar 30 includes a U-shaped frame notch or hollow 32 and a frame support 34, the frame support 34 being disposed rearwardly of the frame hollow 32. In the preferred embodiment, the frame collar 30 is formed from a single piece of metal material, all portions of it being integrally formed, although other strengthy materials could be used. The frame support 34 could also comprise a sleeve in the case where the strut 22 is fabricated of a solid material rather than tubular material.

Although not shown, it is to be understood that the first end 24 of the central strut 22 in the preferred embodiment is similarly a hollow member which is functionally adapted to receive the frame collar support 34 therewithin, the cross-sectional profile of the frame collar support 34 being complimentary to that of the first end 24 of the central strut 22.

As long as the frame collar support 34 and the strut end 24 allow one to slip inside the other, this engagement mode is accomplished.

The final adjustment setting of the frame collar 30 relative to the first end 24 of the strut 22 is accomplished by insertion and tightening of some sort of fastener (not shown). The precise type of fastener used is not a limitation of the present invention. The U-shaped hollow 32 of the frame collar 30 is functionally adapted to engage a portion of the horizontally disposed frame member 8 of the boat trailer 6. See FIG. 1.

Situated at the second end 26 of the central strut 22 is a generally "V-shaped" motor collar 40. Refer again to FIG. 4. The motor collar 40 includes a V-shaped notch or hollow 42 and a complimentary collar support 44. As was the case with the frame collar 30, the V-shaped hollow 42 and the support 44 of the motor collar 40 oppose one another and, in the preferred embodiment, are integrally formed with one another. In the preferred embodiment, the motor collar 40 is formed from a single piece of metal material, all portions of it being integrally formed, although other sturdy materials could also be used. The motor collar support 44 is functionally adapted to be inserted within the hollow second end 26 of the central strut 22 and secured in place by some sort of a fastener (not shown). In this fashion, the motor collar 40 is variably and slidably attachable to the second end 26 of the strut 22. This allows the device to be used with and to accommodate various sizes of boats and motors. In the case where the strut 22 would be made of a solid material, as opposed to a hollow material, the motor collar support 44 could be configured as a sleeve-type fabrication.

The V-shaped hollow 42 of the motor collar 40 includes a pair of pads 48 that are functionally adapted to engage the bottom portion 14 of the boat motor 12. In the preferred embodiment, the pads 48 are secured to the motor collar 40 with fasteners 49 and are fabricated of a material to prevent marring, scuffing and scratching of the lower boat motor portion 14. See FIG. 1.

It should also be noted that, given the geometry of the horizontal boat frame member 8 relative to the vertically oriented boat motor 12 and, in particular, the bottom portion 14 thereof, the plane which defines the frame collar 30 is disposed 900 from the plane that defines the motor collar 40. See FIG. 4. If the boat frame member 8 were oriented vertically, then the plane of each collar 30, 40 would be one in the same. Given the adjustability of the central strut 22 relative to the collar supports 34, 44, this is a relatively easy situation to accommodate.

Figure 2:
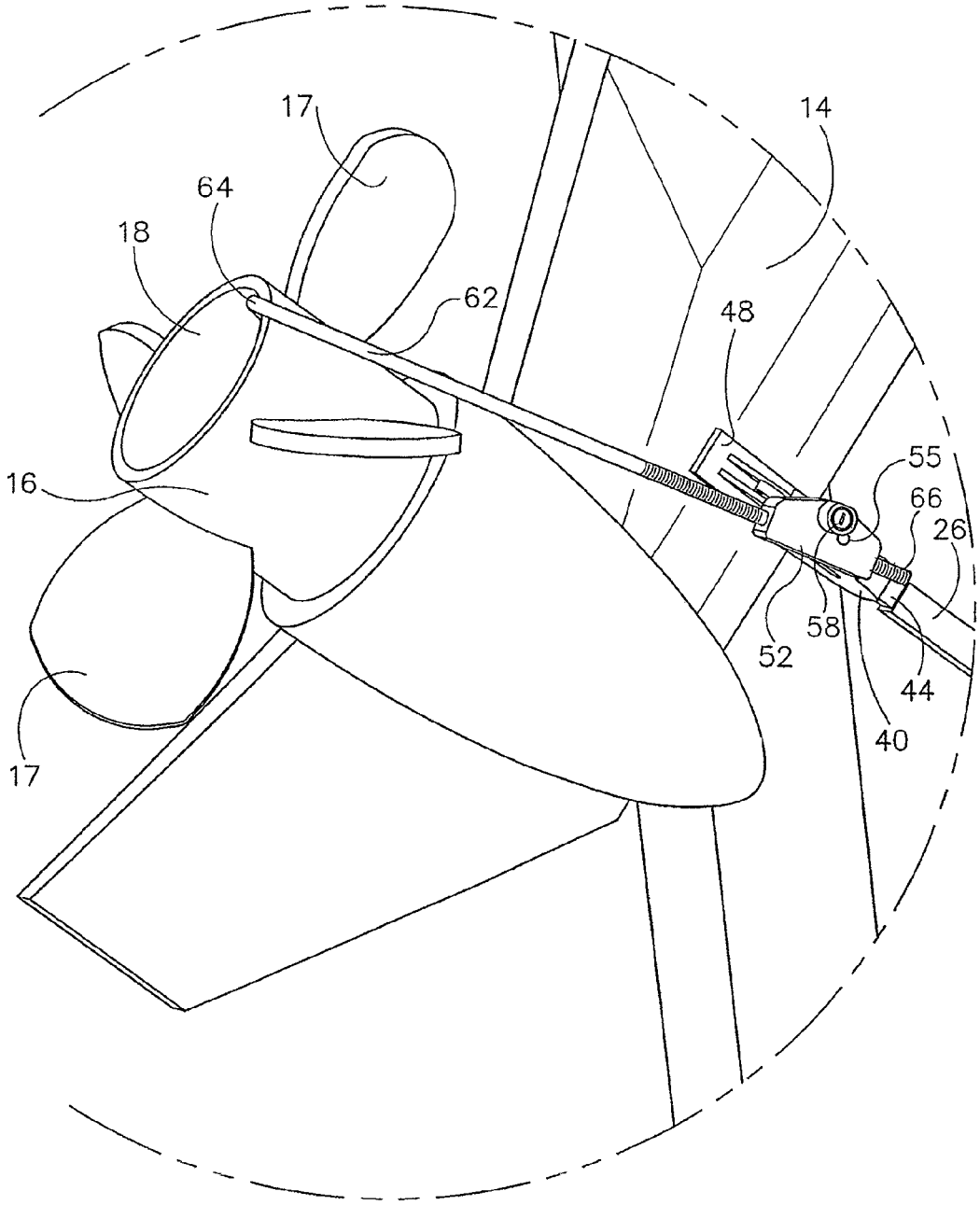
FIG. 2 is an enlarged perspective view of that portion of the device which is illustrated within line 2 of FIG. 1 and showing the combined supporting and locking device in the "locked" position relative to the boat motor propeller.
Figure 3:
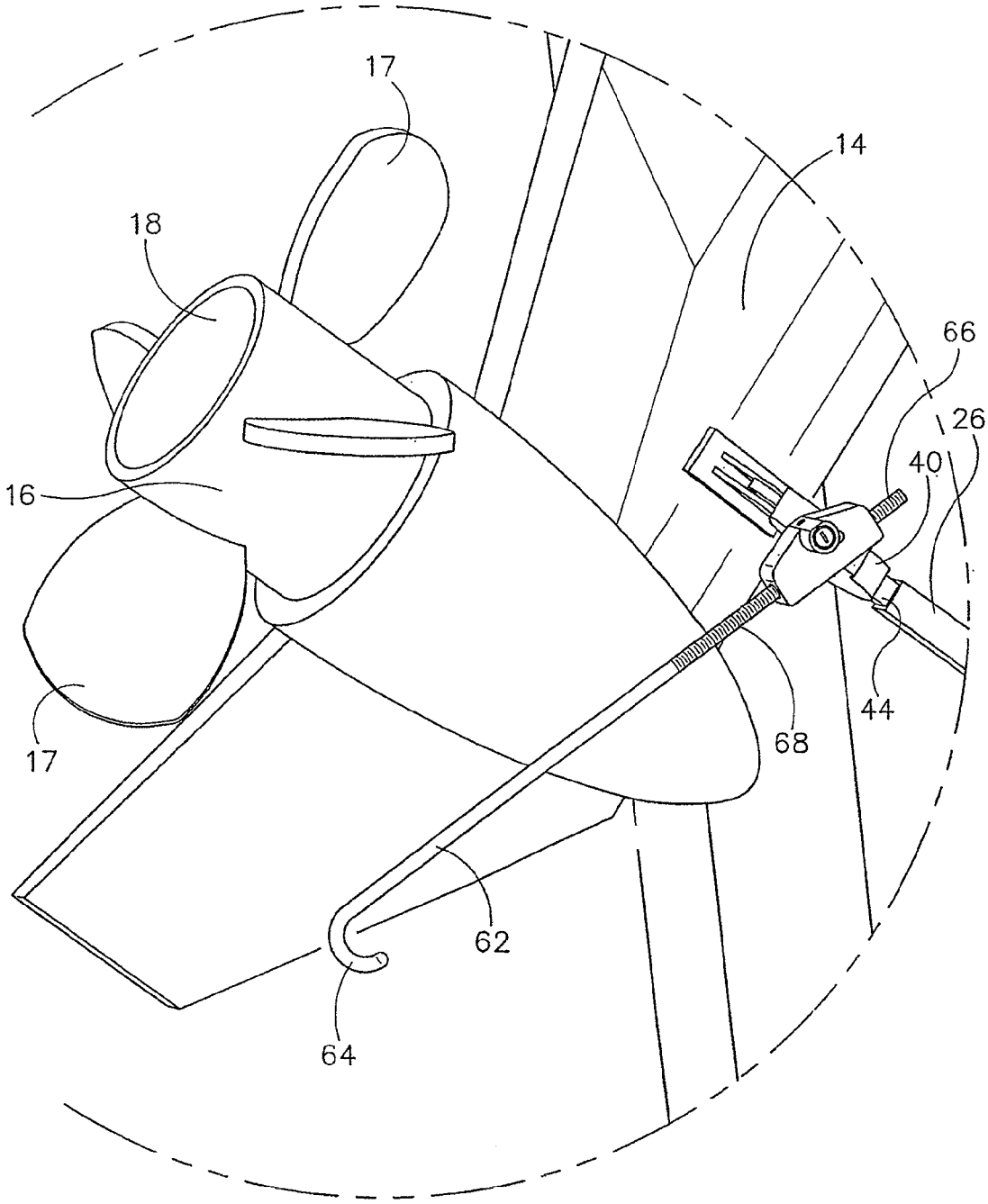
FIG. 3 is another enlarged perspective view of that portion of the locking device illustrated in FIG. 2 and showing the combined supporting and locking device in the "unlocked" position relative to the boat motor propeller.

The lock portion 50 of the combined supporting and locking device 10 includes a primary locking flange 52 which is attached to and is rotatable about one side 46 of the motor collar 40 by means of a fastener 55. See FIGS. 2 and 3. The flange 52 includes an aperture or opening 54, which opening 54 is functionally adapted to receive a portion of a hook-shaped rod, generally identified 60. One end 62 of the rod 60 includes a hook 64 and the opposite end 66 includes a plurality of adjacent ridges 68 defined within the rod 60. A key way 56 is disposed within the flange 52 and is functionally adapted to receive a key and lock mechanism 58 therewithin. It is to be understood that the key and lock mechanism 58 allows a portion of the mechanism to engage a portion of the rod 60 between a pair of adjacent ridges 68, thereby preventing longitudinal movement of the rod 60 within the opening 54. This restriction of movement is what allows the locking of the device 10 to occur, as will be more apparent later in this detailed description. The hook end 64 of the rod 62 is functionally adapted to extend alongside the bottom motor portion 14, through and between a pair of adjacent propeller blades 17, and to then hook a portion of the recess 18 that is defined within the rearward portion of the propeller 16. In the preferred embodiment, the hook end 64 of the rod 62 is coated with a cushioning material, such as plastic or vinyl, which prevents marring, scuffing or scratching of the propeller 16 or its blades 17.

In application, the user of the combined supporting and locking device 10 elevates the boat motor 12 relative to the boat transom 4 and the motor's transom attachment means 13. With the bottom motor portion 14 urged away from the transom 4, the user can insert the support portion 20 of the device 10 between the bottom motor portion 14 and the horizontal boat trailer frame member 8. Although it is understood that the adjustability of the device 10, and particularly the lengthwise adjustability afforded by means of the U-shaped frame collar 30 and the V-shaped motor collar 40, the device 10 can be used with a wide variety and sizes of boats 2. The device 10 can even be manufactured in such a way that other mechanisms for attaching and securing the U-shaped frame collar 30 and the V-shaped motor collar 40 to the strut 22 can be used without deviating from the scope of this invention. For purposes of discussion and explanation of the fundamental concepts included here, it is to be understood that the central strut 22 of the preferred embodiment is a square hollow member and the collar supports 34, 44 are complimentary to it. With the support portion 20 of the device 10 firmly in place, it is the experience of this inventor that additional support is afforded during transport of the motor 12 and boat 2 whereby torsional forces that are otherwise exerted by the transom attachment means 13 on the transom 4 itself are substantially reduced. Thus, the support concept of this combined device 10 is fulfilled.

With the support portion 20 in place, the user rotates the lock flange 52 to allow general alignment with axis of the lock flange opening 54 in the direction of the boat propeller 16. Making sure that the lock mechanism 58 is in the "unlocked position" and while continuing to hold the flange 52 in the foregoing position, the user inserts the second end 66 of the hook shaped rod 60 into the opening 54. The user then urges the rod 60 through the opening 54 to the point that the hook end 64 of the rod 60 engages the rearward recess 18 defined within the propeller 16. With the rod 60 in this position, the user then actuates the key and lock mechanism 58 to the "locked" position such that a pair of ridges 68 of the rod 60 are used to secure the rod 60 in place. With the rod 60 secured in this fashion, and with the rod 60 extending between adjacent blades 17 of the propeller 16, the propeller 16 cannot be rotated or backed off relative to the lower portion 14 of the boat motor 12. Thus, the lock concept of this combined device 10 is fulfilled.

Additional advantages and modifications will readily occur to those skilled in the art. Therefore, the invention in its broader aspects is not limited to the specific details disclosed and described herein. Accordingly, various modifications may be made without departing from the spirit or scope of the general inventive concept.

What is claimed is:

1. A combined supporting and locking device (10) for use with a trailered (6) boat (2) and motor (12), said boat trailer (6) including a frame having at least one frame member (8) and said boat motor (12) including a propeller (16) and rearward propeller recess (18), comprising:

a supporting portion (20), said supporting portion (20) being removably attachable between the at least one frame member (8) of the boat trailer (6) and the boat motor (12), a locking portion (50), means (64) for securing the locking portion (50) to the supporting portion (20), and means (52) for securing the locking portion (50) to the rearward recess (18) of the boat motor propeller (16) to prevent removal of the propeller (16) from the motor (12).

2. The combined supporting and locking device (10) of claim 1 wherein the supporting portion (20) includes a central strut (22), a frame member collar (30) and a boat motor collar (40).

3. The combined supporting and locking device (10) of claim 2 wherein the central strut (22) includes a first end (24) and a second end (26) and the supporting portion (20) further includes means (34) for removably attaching the frame member collar (30) to the first end (24) of the strut (22) and means (44) for removably attaching the boat motor collar (40) to the second end (26) of the strut (22).

4. The combined supporting and locking device (10) of claim 3 wherein the locking portion (50) includes a lock flange (52) and the means (52) for securing the locking portion (50) to the supporting portion (20) includes a fastener (55) securing the lock flange (52) to a portion (42) of the boat motor collar (40).

5. The combined supporting and locking device (10) of claim 4 wherein the lock flange (52) is rotatable about the lock flange fastener (55).

6. The combined supporting and locking device (10) of claim 5 wherein the lock flange (52) includes an opening (54) defined within it.

7. The combined supporting and locking device (10) of claim 6 wherein the means (64) for securing the locking portion (50) to the rearward recess (18) of the boat motor propeller (16) includes a hook-shaped rod (60) having a first straight end (66) and a second hooked end (62), the first straight end (66) being functionally adapted to be received within the lock flange opening (54).

8. The combined supporting and locking device (10) of claim 7 wherein the second hooked end (62) of the hook-shaped rod (60) is functionally adapted to be received within the rearward recess (18) of the boat motor propeller (16).

9. The combined supporting and locking device (10) of claim 8 wherein the locking portion (50) further includes a lock mechanism (58) within the lock flange (52) and also includes a series of ridges and valleys (68) defined within the first straight end (66) of the hook-shaped rod (60), the series of ridges and valleys (68) being engagable with the lock mechanism (58) to prevent movement of the rod (60) within the lock flange opening (54).

10. A combined support and lock device (10) for use with a boat (2) and motor (12), wherein the boat (2) and motor (12) include a trailer (6) having a frame with at least one frame member (8), the boat (2) includes a transom (4), the boat motor (12) being attached to the transom (4), and includes a propeller (16) having a rearward propeller recess (18), which comprises:

a motor support portion (20), said motor support portion (20) being positionable between the at least one frame member (8) of the boat trailer (16) and the boat motor (12) for supporting the boat motor (12) relative to the boat transom (4), a propeller lock portion (50), said propeller lock portion (50) being secured to the motor support portion (20), and means (60) for securing the propeller lock portion (50) to the rearward recess (18) of the boat motor propeller (16) to prevent removal of the propeller (16) from the boat motor (12).

11. The combined support and lock device (10) of claim 10 wherein the support portion (20) includes a central strut (22), a generally U-shaped frame member collar (30) and a generally V-shaped boat motor collar (40).

12. The combined support and lock device (10) of claim 11 wherein the central strut (22) includes a first end (24) and a second end (26) and the support portion (20) further includes means (34) for removably attaching the frame member collar (30) to the first end (24) of the strut (22) and means (44) for removably attaching the boat motor collar (40) to the second end (26) of the strut (22).

13. The combined support and lock device (10) of claim 12 wherein the propeller lock portion (50) includes a lock flange (52) and the means (55) for securing the lock portion (50) to the support portion (20) includes a fastener (55) securing the lock flange (52) to a portion (42) of the boat motor collar (40).

14. The combined support and lock device (10) of claim 13 wherein the lock flange (52) is variably positionable relative to the support portion (20).

15. The combined support and lock device (10) of claim 14 wherein the lock flange (52) further includes an aperture (54) defined within it.

16. The combined support and lock device (10) of claim 15 wherein the means (60) for securing the lock portion (50) to the rearward recess (18) of the boat motor propeller (16) includes a hook-shaped rod (60) having a first straight end (66) and a second hooked end (62), the first straight end (66) being functionally adapted to be received within the lock flange aperture (54) and the second hooked end (62, 64) of the hook-shaped rod (60) is functionally adapted to be received within the rearward recess (18) of the boat motor propeller (16).

17. The combined support and lock device (10) of claim 16 wherein the lock portion (50) further includes a lock mechanism (58) within the lock flange (52) and the first straight end (66) of the hook-shaped rod (60) includes a series of ridges and valleys (68) defined within it, the series of ridges and valleys (68) being engagable with the lock mechanism (58) to prevent longitudinal movement of the rod (60) within the lock flange aperture (54) and removal therefrom when the lock mechanism (58) is in the "locked" position.

18. The combined support and lock device (10) of claim 17 wherein the hooked end (62, 64) of the hooked-shaped rod (60) is coated with a cushioning material to prevent marring of the propeller (16).

* * * * *